US010384221B2

(12) United States Patent
Lee et al.

(10) Patent No.: US 10,384,221 B2
(45) Date of Patent: Aug. 20, 2019

(54) PUMP HEAD FOR A METERING DEVICE, METERING DEVICE AND ALSO POSSIBILITIES FOR USE

(71) Applicant: F. Holzer GmbH, St. Ingbert (DE)

(72) Inventors: Hyek Hee Lee, St. Ingbert (DE); Ute Steinfeld, St. Ingbert (DE); Markus Mahler, Völklingen (DE); Frank Holzer, St. Ingbert (DE)

(73) Assignee: F. Holzer GmbH, St. Ingbert (DE)

( * ) Notice: Subject to any disclaimer, the term of this patent is extended or adjusted under 35 U.S.C. 154(b) by 0 days.

(21) Appl. No.: 15/520,116

(22) PCT Filed: Oct. 7, 2015

(86) PCT No.: PCT/EP2015/073198
§ 371 (c)(1),
(2) Date: Apr. 19, 2017

(87) PCT Pub. No.: WO2016/062541
PCT Pub. Date: Apr. 28, 2016

(65) Prior Publication Data

US 2017/0291183 A1 Oct. 12, 2017

(30) Foreign Application Priority Data

Oct. 21, 2014 (DE) ..... 10 2014 221 393

(51) Int. Cl.
*B05B 11/00* (2006.01)

(52) U.S. Cl.
CPC .... *B05B 11/00444* (2018.08); *B05B 11/0005* (2013.01); *B05B 11/3001* (2013.01);
(Continued)

(58) Field of Classification Search
CPC ..... B05B 11/00444; B05B 11/0005; B05B 11/0021; B05B 11/3001; B05B 11/3047; B05B 11/305; B05B 11/3074
(Continued)

(56) References Cited

U.S. PATENT DOCUMENTS 3,627,206 A 12/1971 Boris
3,949,906 A 4/1976 Pettersen et al.
(Continued)

FOREIGN PATENT DOCUMENTS

CN 103796934 A 5/2014
DE 19542959 C1 10/1996
(Continued)

OTHER PUBLICATIONS

Inventor: Geimer Guenter et al.; Ursatec Verpackung; English Translation from Espace.net of DE 19542959 (furnished in the IDS in German); Oct. 24, 1996, pp. 1-3.*
(Continued)

*Primary Examiner* — Paul R Durand
*Assistant Examiner* — Andrew P Bainbridge
(74) *Attorney, Agent, or Firm* — Schwegman Lundberg & Woessner P.A.

(57) ABSTRACT

The present invention relates to a pump head for a metering device for a metered dispensing of a fluid. The pump head can thereby be fitted on a storage container, for example a bottle, which is designed for storing the fluid to be dispensed. Pump head and storage vessel together thereby form the metering device according to the invention. The pump head is distinguished by including a passage for air, by means of which air from outside can be transferred into the storage vessel during the pumping process for pressure compensation. The present invention relates in addition to purposes of use for the pump head and the metering device.

19 Claims, 5 Drawing Sheets

(52) U.S. Cl.
CPC ..... *B05B 11/305* (2013.01); *B05B 11/3047* (2013.01); *B05B 11/3074* (2013.01)

(58) Field of Classification Search
USPC ..... 222/321.6
See application file for complete search history.

(56) References Cited

U.S. PATENT DOCUMENTS

| | | | | |
|---|---|---|---|---|
| 4,056,216 | A | 11/1977 | Kotuby | |
| 4,775,079 | A | 10/1988 | Grothoff | |
| 4,830,284 | A | 5/1989 | Maerte | |
| 5,842,605 | A * | 12/1998 | Lehmkuhl | B05B 11/0043 222/95 |
| 6,053,368 | A * | 4/2000 | Geimer | A61L 2/16 222/189.09 |
| 6,851,583 | B2 * | 2/2005 | Masuzzo | B05B 11/0005 222/321.6 |
| 9,259,752 | B2 * | 2/2016 | Dumont | B05B 11/0056 |
| 9,694,377 | B2 * | 7/2017 | Michaux | B05B 11/0018 |
| 2004/0200860 | A1 * | 10/2004 | Buxmann | B05B 11/0032 222/321.6 |
| 2009/0236445 | A1 * | 9/2009 | Lintern | A61M 11/00 239/483 |
| 2014/0217124 | A1 * | 8/2014 | Kim | B05B 1/3415 222/321.9 |

FOREIGN PATENT DOCUMENTS

| | | | |
|---|---|---|---|
| EP | 1380351 | A1 | 1/2004 |
| EP | 2759490 | A2 | 7/2014 |
| RU | 2013113678 | A | 10/2014 |
| WO | WO-9848943 | A1 | 11/1998 |
| WO | WO-98048943 | A1 | 11/1998 |
| WO | WO-2012031775 | A1 | 3/2012 |

OTHER PUBLICATIONS

"International Application No. PCT/EP2015/073198, International Search Report dated Dec. 8, 2015", w/ English Translation, (Dec. 8, 2015), 5 pgs.

"International Application No. PCT/EP2015/073198, Written Opinion dated Dec. 8, 2015", (Dec. 8, 2015), 5 pgs.

"International Application No. PCT/EP2015/073198, International Preliminary Report on Patentability dated Apr. 25, 2017", (Apr. 25, 2017), 8 pgs.

"Chinese Application Serial No. 201580057191.8 Office Action dated Aug. 27, 2018", (Aug. 27, 2018), 22 pgs.

"Russian Application No. 201711382/045 Office Action dated Nov. 29, 2018",w/English Translation, 9 pgs.

"Russian Application No. 201711382/045 Search Report dated Nov. 28, 2018", w/English Translation, 4 pgs.

"European Application Serial No. 15 778 637.7, Office Action dated Feb. 22, 2019", w/ Concise Statement of Relevance, (Feb. 22, 2019), 6 pgs.

"Chinese Application Serial No. 201580057191.8, Office Action dated Apr. 18, 2019", w/ English Translation, (Apr. 18, 2019), 8 pgs.

* cited by examiner

PUMP HEAD FOR A METERING DEVICE, METERING DEVICE AND ALSO POSSIBILITIES FOR USE

PRIORITY APPLICATIONS

This application is a U.S. National Stage Filing under 35 U.S.C. 371 from International Application No. PCT/EP2015/073198, filed on 7 Oct. 2015, and published as WO2016/062541 on 28 Apr. 2016, which claims the benefit of priority of German Application No, 10 2014 221 393.2, filed on 21 Oct. 2014; which applications and publication are incorporated herein by reference in their entirety.

The present invention relates to a pump head for a metering device for a metered dispensing of a fluid. The pump head can thereby be fitted on a storage container, for example a bottle, which is designed for storing the fluid to be dispensed. Pump head and storage vessel together thereby form the metering device according to the invention. The pump head is distinguished by the fact that it comprises a passage for air, by means of which air from outside can be transferred into the storage vessel during the pumping process for a pressure compensation. The present invention relates in addition to purposes of use for the pump head and the metering device.

Metering devices which are designed to be airless, i.e. no air flows into the interior of the device during the metering process, are known from the state of the art, such as for example from WO 2012/031775 A1. In addition to the storage container, these metering devices have a further bag which contains the fluid to be metered. Because of the prevailing low pressure when dispensing the fluid, this bag is collapsed so that dispensing the fluid is possible. However, the relatively complex and fault-prone construction, in particular of the storage container, is disadvantageous with such metering devices. In addition, such systems are relatively heavy and expensive.

It was therefore the object of the present invention to provide a pump head or a metering device which avoids the previously mentioned disadvantages. This object is achieved, with respect to a pump head, by the features of patent claim 1, with respect to a metering device, by the features of patent claim 19 and also, with respect to purposes of use, by the features of patent claim 21. The respective dependent patent claims thereby represent advantageous developments.

The invention hence relates to a pump head for a metering device for a metered dispensing of a fluid, comprising a pump housing which has a pressure chamber, an inlet valve which delimits the pressure chamber, a cone which is arranged moveably in the pressure chamber of the pump housing and includes a through-channel, the cone being dimensioned in a part orientated towards the inlet valve such that it can be guided in a form-fit in the pressure chamber and being dimensioned smaller in diameter in the remaining parts, an outlet valve via which the dispensing of the fluid is effected, the outlet valve being in fluidic communication with the through-channel of the cone, and also a component which narrows the diameter of the pressure chamber in the part situated opposite the inlet valve and which is configured for guiding the cone.

The pump head according to the invention is distinguished by the pump head having at least one air inlet for guidance of air, the air inlet comprising a passage for air between cone and component and also at least one through-opening for air in the pump housing, which are opened when the cone is transferred into an outlet position in which the pump head dispenses fluid.

In the case of the pump head according to the invention, it is hence crucial that it has a pump housing with a pressure chamber, the cone being insertable into the pressure chamber in a form-fit and being moveable herein. By means of moving the cone into the pressure chamber, the volume of the pressure chamber is reduced so that fluid situated in the pressure chamber is conveyed out of the pressure chamber through the through-channel situated in the cone. The cone is thereby guided in a sealed manner relative to the wall of the pressure chamber or has for example corresponding sealing elements.

Because of the fact that the cone outside the pressure chamber has a smaller diameter than the pressure chamber and is hence narrowed, an air-inlet passage, which enables the air entry from the environment of the pump head into the interior of the pump head and hence for example also into a storage vessel for fluid to be dispensed which is mounted on the pump head, can be opened. This passage is then opened in particular when the cone is transferred from an inoperative position into a dispensing position. As described previously already, a reduction in the volume of the pressure chamber thereby takes place and the fluid contained in the pressure chamber is conveyed out of the pressure chamber by means of the cone. During this movement process of the cone inside the pressure chamber, a through-opening in the wall of the pressure chamber, i.e. in the pump housing, is thereby exposed or opened so that, during exit of the fluid, air can enter at the same time into the pump head, or into the storage vessel for the fluid to be dispensed, through the unsealed housing.

One particular advantage of the pump head according to the invention or of a metering device according to the invention is thereby that a simplified system, compared with hermetically sealed metering systems, can be achieved. Nevertheless, it is possible to store the stored fluid in the metering device without preservatives, which, in particular in the case of pharmaceutical applications, such as for example eye- and/or nasal sprays, is advantageous.

According to a preferred embodiment, the internal diameter of the component has a smaller dimension than the internal diameter of the pressure chamber. Hence also the cone in the vicinity of the component has a smaller dimension than in the pressure chamber.

In particular in the case where the diameter of the cone, starting from the diameter in the vicinity of the pump chamber, reduces down to the diameter in the vicinity of the component, preferably reduces strictly monotonically, in particular the cone is configured conically in the vicinity of the component, it can be the case that, because of the reducing diameter of the cone, the latter abuts on the component in the inoperative position or seals with the component in a form-fit. Because of this abutment, an automatic sealing function can be provided so that an air-inlet passage is closed in the inoperative position of the cone. According to this preferred embodiment position, the cone is hence mounted in a sealed manner relative to the component in the closed position of the pump head.

Furthermore, it is hereby advantageous that the component has a guiding rib by means of which it is guided. The guiding rib thereby surrounds the cone in the vicinity of the component 6 in a form-fit at least in parts so that precise and reliable guidance of the cone in the component is made possible. As a result, precise guidance of the cone in the pump housing or in the pressure chamber is made possible, on the other hand, so that an inadvertent fluid exit due to fluid guidance laterally past the cone can be avoided.

In addition, it is advantageous that the air inlet comprises at least one boring which is located in the component.

A particular embodiment of the pump head provides that an insert is arranged between a fluidic outlet and the outlet valve, which insert has a shell which surrounds an inner cavity which surrounds the outlet valve, a through-opening (pin-hole) which leads through a wall of the shell and opens into at least one fluid-guidance channel arranged on the outer surface of the shell, the at least one fluid-guidance channel being guided preferably in an upper part of the shell around the latter and being supplied to an outlet end of the shell and the at least one fluid-guidance channel being delimited by a pump head upper part which incorporates the insert in a form-fit.

In this embodiment, the fluid-guidance channel in the insert is arranged on the surface of a shell, i.e. the fluid-guidance channel thereby represents a recess in this shell. The fluid-guidance channel is thereby sealed by the pump head upper part which incorporates the insert in a form-fit. At the positions of the recess of the fluid-guidance channel in the surface of the shell, hence a continuously configured fluid-guidance channel is produced hence by the delimitation which is produced by the pump head upper part.

Preferably, the insert has a device for sterilisation, degermination or germ-reduction of the fluid, preferably a silver spiral, and/or the pump head upper part and/or the insert comprises antibacterial or bacteriostatic material or is formed herefrom.

Because of the fact that the fluid-guidance channel is not guided in a straight line on the surface of the shell but, as preferably described previously, is guided around the shell, the device for sterilisation, degermination or germ-reduction of the fluid can, in the previously described special embodiment, develop maximum effect since the fluid-guidance channel is designed to be as long as possible because of its guidance.

The outlet valve is thereby preferably designed as cylinder valve, this cylinder valve comprises a closing body which closes the through-channel of the cone in the closed position of the pump head and, in outlet position of the pump head, opens the through-channel of the cone and also the through-opening (pin-hole) of the shell.

The closing body is pressed upwards during the pumping process, i.e. transfer of the cone from the inoperative position into the dispensing position, by fluid flowing out of the through-opening. The closing body hereby opens the pin-hole, i.e. the through-opening, in the insert so that the fluid can enter through the through-opening into the fluid-guidance channel.

After completion of the metering process, no additional fluid passes through the throughflow opening so that the closing body can return into its original position and can close the through-opening of the cone and also the pin-hole.

The return of the closing body into this position closing the through-channel is preferably assisted by a return spring.

A further particularly preferred embodiment provides that, inside the air inlet, at least one air-permeable device for sterilisation, degermination or germ-reduction of the air is provided, preferably a bacterial filter, in particular an HEPA filter.

This device is preferably inserted at the upper end of the component. As a result, air which enters in fact as early as possible is sterilised or correspondingly filtered to be sterile so that it is ensured that no germs can pass through the pump head and hence enter into the storage vessel for the fluid.

Furthermore, it is preferred that a pump head upper part is present which surrounds the outlet valve and also an outlet opening, which abuts on the outlet valve, and the cone, the pump head upper part being arranged moveably relative to the component so that the cone can be guided in the pressure chamber by means of the pump head upper part.

This pump head upper part is connected to the component in particular by means of a return spring.

Furthermore, it is advantageous if the component is configured as a separate component and is connected to the pump housing, preferably via a snap-on connection.

The pump head is preferably connectable via this component to a storage container for storing the fluid to be dispensed, preferably via a snap-on connection.

The inlet valve, via which the fluid can be introduced into the pressure chamber from the storage container, can in addition comprise a riser pipe, in particular in the case where fluids in the upright state (i.e. the pump head is arranged above the storage container) of a corresponding metering device are intended to be dispensed. Likewise, embodiments of a metering device which is provided with a corresponding pump head and does not comprise a riser pipe are however possible, for example in the case where the metering device is intended to be emptied via the top, as is the case in particular for example with eye drops.

The inlet valve can represent in particular a disc valve, a cylinder valve or a ball valve. With reference to the embodiments with respect to a cylinder valve, reference is made in particular to the already previous embodiments. A disc valve is particularly preferred.

The invention relates in addition also to a metering device for a metered dispensing of a fluid which comprises a previously described pump head. The pump head according to the invention is thereby connected to a storage container for storing the fluid to be dispensed. This storage container has an opening and is connected to the pump head at the opening via the component of the pump head in a manner sealing against fluids.

The sealing connection can be achieved in particular by a flange or a gasket being fitted between pump head and storage container.

In addition, the present invention relates to possibilities for using the pump head or the metering device. In particular, the previously mentioned components are suitable for a metered dispensing of liquid or semi-solid contents, such as e.g. solutions, sprays, gels, ointments, creams, pastes, in particular for pharmaceutical applications, preferably eye drops, eye sprays, nasal drops, nasal sprays and in the foodstuff sphere.

With the pump head according to the invention and the metering device according to the invention, in particular the following advantages can be achieved: no metal contact of the fluid inside the device is provided, with the exception of the possibly present silver spirals which can be inserted for example as device for sterilisation of the fluid, in particular in the upper part of the pump head.

The silver spiral can be replaced, additionally or alternatively hereto, by an antibacterial additive, for example a thermoplastic injection moulding compound, from which the pump head upper part and/or the shell of the insert are formed.

On the basis of the special channel guidance in the shell of the insert which represents an extension of the direct path, bacterial entry via the outlet opening is further impeded.

In particular if the fluid channel in the shell is guided around the shell, horizontal passages of the fluid channel are developed. Because of this fact, bacteria cannot reach the pin-hole because of gravity conditions so that entry of bacteria is consequently further impeded.

The bacteria contained in the general air intake can be filtered off by antibacterial filters.

In addition, the activation time of the pump head or of the metering device can be reduced in the above-described component of the pump head by additional air channels which open during activation.

Because of the fact that the air channel was opened exclusively when activated and is closed otherwise, the microbial security of the pump head or of the metering device is further increased.

The present invention is explained in more detail with reference to the subsequent figures without restricting the invention to the illustrated special parameters.

Figure 1:
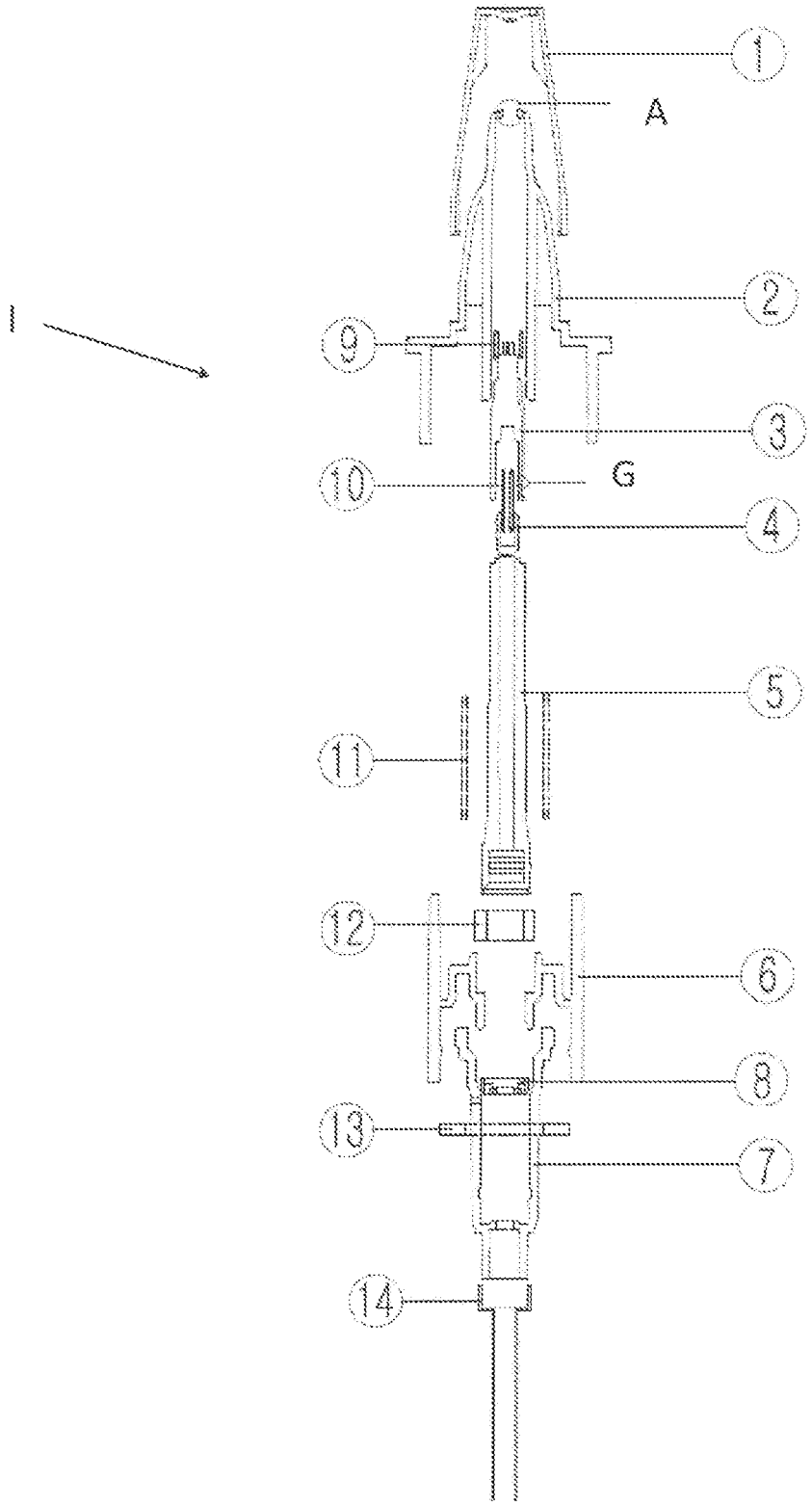
FIG. 1 shows an exploded view of an example of a pump head, in accordance with some embodiments.

FIG. 1 shows an exploded drawing of a pump head according to the invention. The pump head I thereby has a pump head upper part 2 which has an outlet opening A. The pump head upper part thereby has a cavity into which an insert 3 is insertable in a form-fit. This insert has a through-opening G (pin-hole) via which fluid from the interior can be guided to the surface of the insert. The surface has a fluid-guidance channel which is not illustrated in more detail in FIG. 1. In addition, the insert 3 has a silver spiral 9 which is intended for disinfection or killing of bacteria which possibly enter into the pump head I via the outlet hole A. The insert 3 consists of a shell which has a cavity illustrated in the lower part of the shell. An outlet valve 4 which closes the through-opening of the cone 5 in the closed position is inserted into this cavity. The valve 4 is thereby a cylinder valve and is retained in position via a return spring 10. The abutting cone 5 has a through-channel via which the cone 5 can be subjected to a flow of fluid. This cone 5 is retained in a pump housing 7 via a component 6. The lower part of the cone 5 can thereby be introduced into the cavity of the pump housing 7, i.e. into the pressure chamber, in a form-fit, the upper tapering part of the cone 5 is thereby retained and guided through the corresponding opening of the component 6. The component 6 thereby has a recess into which a bacterial filter, for example an HEPA filter 12, can be inserted. The lower end of the pump housing 7 has an outlet opening which can be sealed relative to the exterior of the pump chamber 7 via a disc valve. At the lower end, a riser pipe can likewise possibly be present. In addition, a flange or a gasket 13 can be arranged over the pump housing in order to enable a sealing connection to a storage container, not illustrated in FIG. 1. The pump head I can thereby likewise comprise a protective cap 1 which can be applied on the pump head upper part and protects the outlet opening A.

Figure 2:
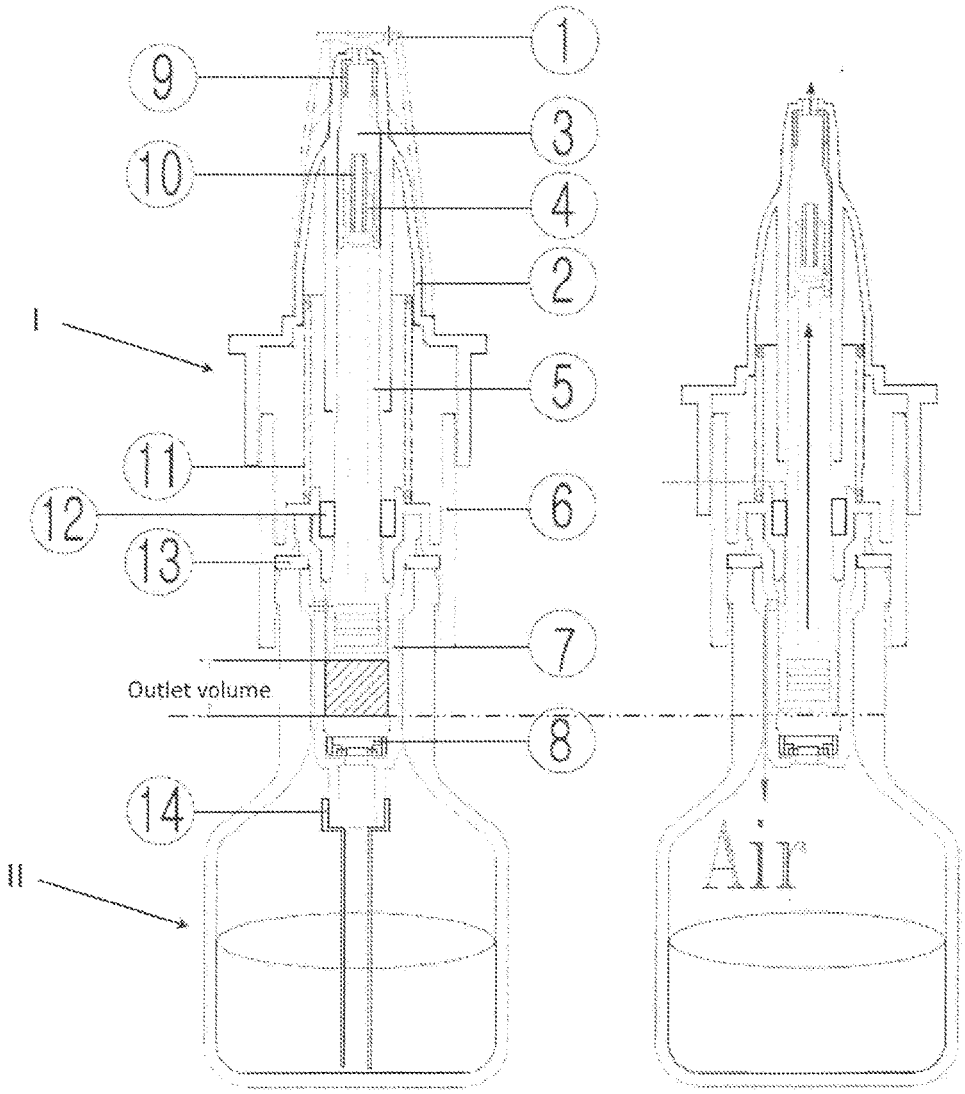
FIG. 2 shows an example of a metering device, in accordance with some embodiments.

FIG. 2 shows a metering device according to the invention which comprises a pump head I, described in FIG. 1, which is mounted on a storage vessel II. The same reference numbers thereby denote identical components. In FIG. 2 on the left, the metering device is shown in an inoperative position, in the right-hand figure in an outlet position in which the cone 5 is pressed downwards, compared with the left-hand illustration.

In FIG. 2, the interaction of the individual components can be detected. If a user activates the metering device by pressing the pump head upper part 2 downwards and hence the metering device is transferred into the right-hand position, in the position illustrated on the left in FIG. 2, the cone 5 is pressed downwards into the pump housing. The pump housing 7 thereby contains the fluid to be let out, which is situated in the outlet volume V. Because of the volume reduction which thereby takes place, the fluid situated in the pressure chamber or in the outlet volume V is pressed upwards in the cone. The cone valve 4 is hereby opened so that the fluid passes through the wall of the insert 3 via the pin-hole H which is situated in the insert 3. The fluid is hence guided in the fluid-guidance channels situated on the surface of the insert 3 towards the outlet opening A and emerges there. In the upper part of the insert 3, a silver spiral prevents contamination of the fluid situated in the outlet opening. During the pumping process, air can enter into the storage container II via the path illustrated in the right-hand figure for pressure compensation. The air thereby follows a path via the sterile filter 12 through the passage illustrated in the right-side illustration in FIG. 2. Between the component 6 and the cone 5, a non-hermetically sealed gap via which air can enter is thereby situated. When the cone 5 is moved downwards in the pressure chamber, in addition a through-opening in the wall of the pump housing 7 is opened, via which the air flow can enter into the interior of the storage container II and hence a pressure compensation takes place. After completion of the activation process, the cone is guided back into the initial position. This is made possible automatically by the return spring 11. The air-inlet passage is hereby closed, the inlet valve 8 is opened because of the resulting low pressure and fluid from the storage container II is suctioned into the pressure chamber of the pump housing 7. As can be detected likewise in FIG. 2, the cone 5 has a conical configuration and has a reducing external diameter (the maximum external diameter is configured in the vicinity of the pressure chamber of the pump housing 7). In the vicinity of the component 6, the external diameter of the cone 5 is already reduced. At the positions at which the cone 5 impinges on the component 6 in the inoperative positive, a seal is ensured. The component 6 and/or the cone 5 can possibly have additional sealing elements at this position which assist the hermetic seal.

Figure 3:
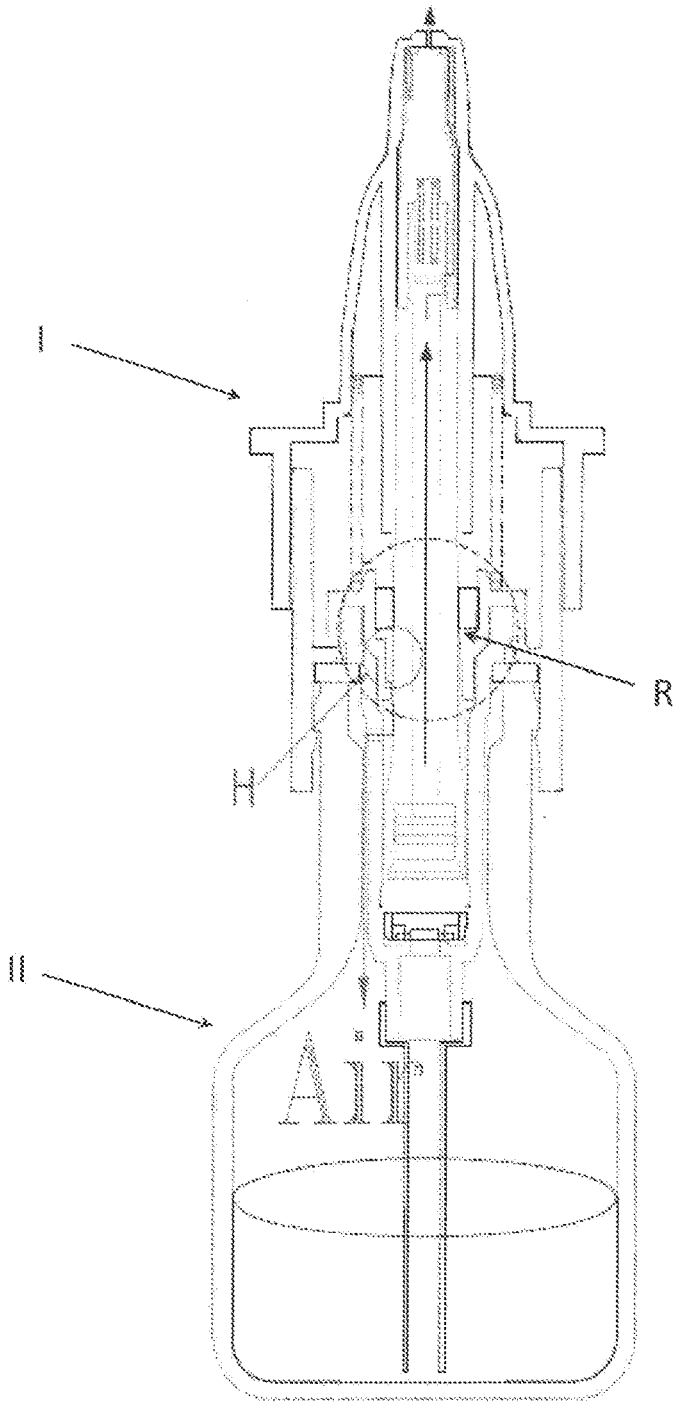
FIG. 3 shows an additional example of a metering device, in accordance with some embodiments.

FIG. 3 shows a further embodiment of the metering device according to the invention. This embodiment according to FIG. 3 has borings H which are present in the component 6. The cavities formed by the borings H thereby abut directly on the cone 5. The component 6 can have for example 1 to 10 such borings. The borings enable easier air passage in the passage discussed already in FIG. 2 so that faster return movement and response of the metering device is given.

In addition, the component 6 has a guiding rib R, in the alternative embodiment illustrated in FIG. 3, this guiding rib is configured for example as a small projection in component 6. This guiding rib R thereby seals with the cone 5 in a form-fit and serves for precise guidance of the cone 5. The cone 5 which is guided by means of the component 6 can hence be guided precisely and in a form-fit in the pump housing 7. The guiding rib R can thereby also be present independently of the borings H, given by way of example in FIG. 3.

Figure 4A:
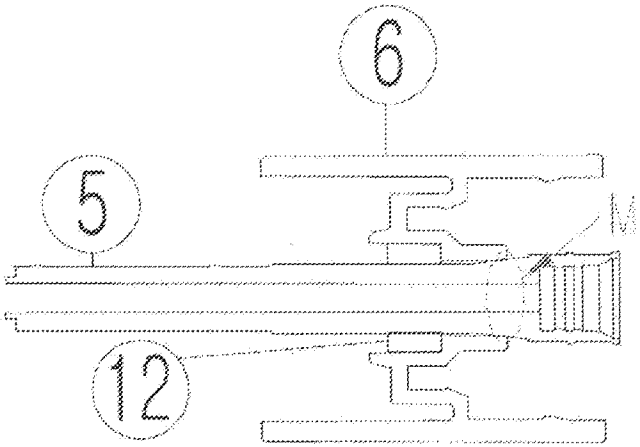
FIG. 4*a* shows an example of a metering device in a closed position, in accordance with some embodiments.

FIG. 4 shows a detail of the interaction of the cone 5 and the component 6. FIG. 4*a* thereby shows the cone 5 in a closed position of the metering device. In the area which is labelled with reference sign M, it is detectable that the cone 5 abuts against the component 6 because of the conical course of the cone 5 in this area and hence a seal is possible.

Figure 4B:
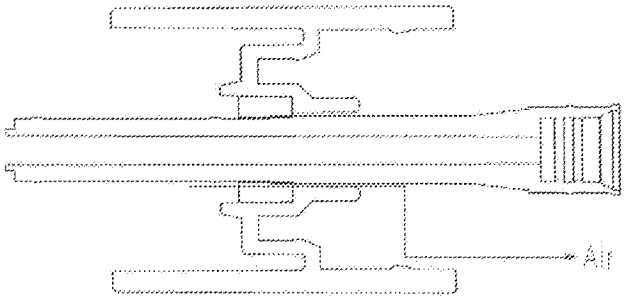
FIG. 4*b* shows an example of a metering device in an open position, in accordance with some embodiments.

In FIG. 4*b* in contrast, the opened position of the metering device is shown, i.e. the case in which the cone 5 is introduced into the pressure chamber. In this case, a passage for air is opened, which enables the pressure compensation in the storage container II, not illustrated in FIG. 4.

Figure 4C:
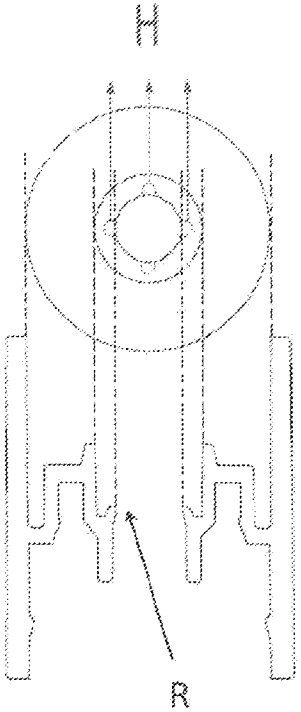
FIG. 4*c* shows an example of an alternative configuration of a component having additional borings, in accordance with some embodiments.

FIG. 4*c* shows an alternative embodiment of the component 6 which, in this case, has additional borings H.

Figure 5:
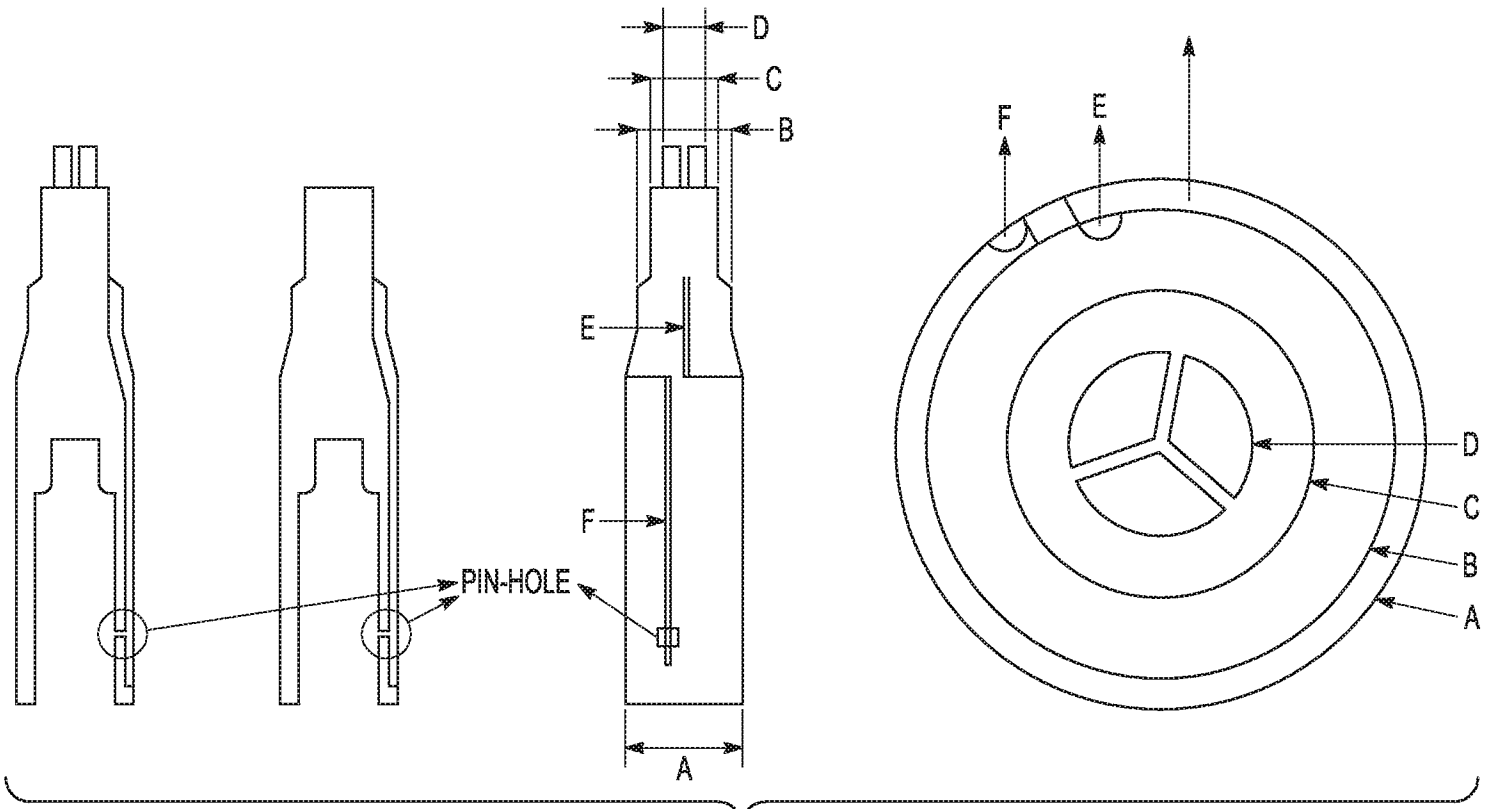
FIG. 5 shows an additional configuration of an insert, in accordance with some embodiments.

FIG. 5 shows special embodiments of the insert 3. This insert can be designed differently depending on the respective configuration. FIG. 3*a*, for example, illustrates an insert which is advantageous in particular for applications with drops. FIG. 3*b* shows, in contrast, an insert which is suitable for a spray. The inserts 3 thereby differ merely in the design of the outlet opening.

However, both embodiments thereby comprise a through-opening, i.e. a so-called pin-hole G, via which communication of the cavity of the insert 3, illustrated at the bottom, is made possible with the fluid channel F. In FIG. 5*c*, a top view on the shell is illustrated, in which the through-opening G and also the fluid-guidance channels F and E are illustrated. The fluid-guidance channels F and E are thereby recesses which are configured in the surface of the insert 3. The fluid-guidance channels are thereby made possible by fitting this insert 3 into a pump head upper part 2 in a form-fit. This is illustrated in fact in detail in FIGS. 1 and 2. The fluid-guidance channel is configured in the case of FIG. 3 such that, in the area of reference sign F, a type of riser pipe from the through-opening G upwards is effected. In the upper part of the insert 3, guidance of the fluid channel is effected horizontally around the insert 3. Subsequently, further guidance of the fluid channel in the area of reference sign E is furthermore effected upwards so that a fluidic communication is possible in the outlet region. FIG. 3*d* shows a top view on the insert 3. In particular, also the graduated diameter of the insert 3 is hereby evident, which is illustrated by the references signs A, B, C and D. In the area of reference sign D, notches can likewise be present so that a targeted formation of drops and dispensing at the outlet opening A is possible.

The invention claimed is:

1. A pump head for a metering device for a metered dispensing of a fluid, the pump head comprising:

a pump housing which has a pressure chamber, an inlet valve which delimits the pressure chamber, a cone which is arranged moveably in the pressure chamber of the pump housing and comprises a through-channel, the cone, in a part orientated towards the inlet valve, being dimensioned to permit the cone to be guided in a form-fit way in the pressure chamber and being dimensioned smaller in cross-section in the parts not being orientated towards the inlet valve, an outlet valve via which the dispensing of the fluid is effected, the outlet valve being in fluidic communication with the through-channel of the cone, and also a component which narrows the diameter of the pressure chamber in a part situated opposite the inlet valve and which is configured for guiding the cone, wherein the pump head has at least one air inlet for guidance of air, the air inlet comprising a passage for air between cone and component and also at least one through-opening for air in the pump housing, wherein the passage for air and at least one through-opening for air are opened when the cone is transferred into an outlet position in which the pump head dispenses fluid, and wherein an insert is arranged between a fluidic outlet and the outlet valve, wherein the insert has a shell that surrounds an inner cavity that surrounds the outlet valve, a through-opening leading through a wall of the shell which opens into at least one fluid-guidance channel arranged on the outer surface of the shell, the at least one fluid-guidance channel being guided in an upper part of the shell around the shell and being supplied to an outlet end of the shell, and the at least one fluid-guidance channel being delimited by a pump head upper part which incorporates the insert in a form-fit.

2. The pump head according to claim 1, wherein the component has a prescribed internal diameter, in which the cone is guided, the internal diameter of the component being smaller than the internal diameter of the pressure chamber.

3. The pump head according to claim 2, wherein the diameter of the cone, starting from the diameter in the vicinity of the pump chamber, reduces down to the diameter in the vicinity of the component.

4. The pump head according to claim 3, wherein, in a closed position of the pump head, the cone is mounted in a sealed manner relative to the component.

5. The pump head according to claim 1, wherein the component has a guiding rib by which the cone is guided.

6. The pump head according to claim 1, wherein the air inlet comprises at least one boring which is located in the component.

7. The pump head according to claim 1, wherein the insert has a device for at least one of sterilisation, degermination, or germ-reduction of the fluid, and/or the pump head upper part and/or the insert comprises at least one of antibacterial or bacteriostatic material or is formed herefrom.

8. The pump head according to claim 1, wherein the outlet valve is a cylinder valve which comprises a closing body which closes the through-channel of the cone in the closed position of the pump head and, in outlet position of the pump head, opens the through-channel of the cone and also the through-opening of the shell.

9. The pump head according to claim 8, wherein, in the closed position of the pump head, the closing body is retained by a return spring in a position which closes the through-channel of the cone.

10. The pump head according to claim 1, wherein, inside the air inlet, at least one air-permeable device for at least one of sterilisation, degermination, or germ-reduction of the air is provided, including a bacterial filter.

11. The pump head according to claim 10, wherein the device for at least one of sterilisation, degermination, or germ-reduction of the air is inserted in the component at the end of the component directed towards the outlet valve.

12. The pump head according to claim 1, comprising a pump head upper part which surrounds the outlet valve and also an outlet opening, which abuts on the outlet valve, and the cone, the pump head upper part being arranged moveably relative to the component to permit the cone to be guided in the pressure chamber by the pump head upper part.

13. The pump head according to claim 12, wherein the pump head upper part is connected to the component by a return spring.

14. The pump head according to claim 1, wherein the component is configured as a separate element and is connected to the pump housing.

15. The pump head according to claim 1, wherein the pump head is connectable via the component to a storage container for storing the fluid to be dispensed.

16. The pump head according to claim 1, comprising a riser pipe which abuts on the side of the inlet valve orientated away from the pressure chamber.

17. The pump head according to claim 1, wherein the inlet valve includes at least one of a disc valve, a cylinder valve, or a ball valve.

18. The pump head of claim 1, in combination with a metering device for a metered dispensing of a fluid, the combination further comprising a storage container for storing the fluid to be dispensed which has an opening and is connected to the pump head at the opening via the component in a manner sealing against fluids, wherein the combination further comprises a flange or a gasket for sealed connection of the pump head to the storage container.

19. A method of using the pump head of claim 18 in combination with the metering device, the method including performing a metered dispensing of liquid or semi-solid contents.

* * * * *